United States Patent [19]

Lipsztajn

[11] Patent Number: 4,767,510

[45] Date of Patent: Aug. 30, 1988

[54] ELECTROLYTIC PROTECTION OF CHLORINE DIOXIDE

[75] Inventor: Marek Lipsztajn, Rexdale, Canada

[73] Assignee: Tenneco Canada Inc., Islington, Canada

[21] Appl. No.: 57,107

[22] Filed: Jun. 3, 1987

[51] Int. Cl.[4] ..... C25B 1/00

[52] U.S. Cl. ..... 204/101

[58] Field of Search ..... 204/101

[56] References Cited

U.S. PATENT DOCUMENTS 4,362,707 12/1982 Hardee et al. ..... 204/101

4,426,263 1/1984 Hardee et al. ..... 204/101

OTHER PUBLICATIONS

Hardee—"The Electrochemical Generation of Chlorine Dioxide Utilizing Electrolytic Oxide Coatings", Extended Abstracts, vol. 85-1, pp. 617 to 618, The Electrochemical Society, 1985.

*Primary Examiner*—R. L. Andrews

*Attorney, Agent, or Firm*—Sim & McBurney

[57] ABSTRACT

Chlorine dioxide is formed by an autocatalytic electrochemical process from highly acidic chlorate solution containing a residual concentration of chlorine dioxide. Cathodic current is applied to the solution by an electrode which does not otherwise catalyze the chemical formation of chlorine dioxide from the acidic chlorate solution. High purity chloride dioxide is obtained while half the acid is consumed and half the water is produced as compared with a conventional chemical chlorine dioxide generating process.

14 Claims, 1 Drawing Sheet

ELECTROLYTIC PROTECTION OF CHLORINE DIOXIDE

FIELD OF INVENTION

The present invention relates to the production of chlorine dioxide by the electrolysis of highly acidic sodium chlorate solutions.

BACKGROUND TO THE INVENTION

Chlorine dioxide is used as a bleach in a variety of environments, notably in the bleaching of wood pulp. Various chemical processes for the generation of chlorine dioxide by reduction of sodium chlorate in aqueous acid media have been described in the past and are in commercial operation. The chemical process may be depicted by the equation (I):

$$2ClO_3^- + 2Cl^- + 4H^+ \rightarrow 2ClO_2 + Cl_2 + 2H_2O \quad (I)$$

U.S. Pat. No. 4,426,263 (Hardee et al) describes an electrolytic process for producing chlorine dioxide using an electrocatalyst comprising a platinum group metal oxide as a cathode coating in an electrolytic cell containing sodium chlorate and sulphuric acid. This patent also describes the use of platinum group metal oxides as a catalyst in the absence of applied electrical current and indicates that this is the preferred embodiment.

Since the material used as the cathode coating is itself a catalyst for the production of chlorine dioxide, the effect of an applied current cannot readily be determined but the data presented in the patent and also in an article by Hardee describing the electrochemical process (see "The Electrochemical Generation of Chlorine Dioxide Utilizing Electrolytic Oxide Coatings", Extended Abstracts, vol. 85-1, pp.617 to 618, The Electrochemical Society, 1985) suggest little beneficial effect of the applied current on the generation of chlorine dioxide.

According to the article, the better efficiencies are observed at lower current values and hence at lower contributions of electrolysis to the overall process of generation of chlorine dioxide. In particular, current efficiencies as low as 20% were observed at higher current densities. The observed loss in efficiency was believed to arise from further reduction of chlorine dioxide.

Poor results obtained in electrolytic experiments carried out at higher current densities are in a good correspondence with the cyclic voltammograms reported in the above-noted Hardee article, where the maximum current density observed for the electroreduction of 0.5M $NaClO_3$ is less than 10 mA/cm$^2$, which is, by an order of magnitude, lower than expected for such a high concentration of reducible species.

The experimental data in the Hardee article indicates to one skilled in the art that the process is not limited by the electrochemical step involving chlorate but rather by a chemical step in which an electroactive species, different from chlorate, is formed, which undergoes subsequently an electroreduction. Accordingly, the rate of reduction of chlorate ion to chlorine dioxide is limited by a chemical reaction rather than an electrochemical one and this chemical reaction can be accelerated by the presence of a catalyst, as described in the Hardee patent and article. Although the platinum metal oxide catalyst appears to enhance the rate of chemical conversion of chlorate ion to chlorine dioxide, its electrocatalytic properties have a detrimental effect on the electrochemical stability of the desired product, namely chlorine dioxide, when practical current densities are applied to electrodes having a surface of such platinum metal oxides.

The Hardee article also claims that the platinum group metal oxides are the only materials which show activity for the reduction of chlorate and data is presented showing the alleged ineffectiveness of platinum.

SUMMARY OF INVENTION

In accordance with the present invention, there is provided an electrochemical process for the production of chlorine dioxide which is based on an autocatalytic cycle utilizing part of the product, namely chlorine dioxide, for generation of the next portion of the same product.

It has been surprisingly found that pure chlorine dioxide, without any substantial contamination by chlorine, can be produced from a chlorate-containing aqueous acid solution having a total acidity greater than that of about 7 normal sulphuric acid by passing a cathodic current through the solution from an electrode constructed of an electrochemically-active material which is also chemically inert with respect to the production of chlorine dioxide from the solution and by maintaining a residual dissolved concentration of chlorine dioxide in the solution.

The mechanism of generation of chlorine dioxide by the electrochemical process of the invention is believed to involve chemical reaction between chlorate ions and electrolytically-produced short-lived chlorite ions to form chlorine dioxide. Part of the chemically-produced chlorine dioxide is electrochemically reduced to form the chlorite ions, while the remainder is removed from the solution as product.

The reactions which are thought to occur may be depicted, as follows:

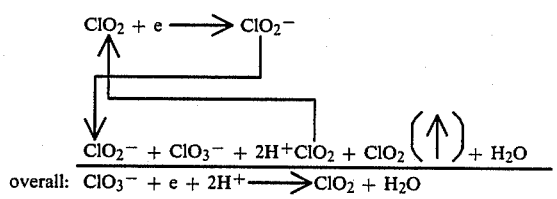

From these equations, it will be seen that the process can be considered autocatalytic, in that generated chlorine dioxide is used to produce the active species for reduction of chlorate ions. A residual concentration of chlorine dioxide must be maintained in the aqueous acid solution to sustain the autocatalytic cycle.

If the cell as a whole is considered, then the anodic and cathodic reactions may be depicted as follows:

$$\begin{array}{ll} \text{Cathode:} & 2ClO_3^- + 2e + 4H^+ \longrightarrow 2ClO_2 + 2H_2O \\ \text{Anode:} & H_2O - 2e \longrightarrow \tfrac{1}{2}O_2 + 2H^+ \\ \hline \text{Cell:} & 2ClO_3^- + 2H^+ \longrightarrow 2ClO_2 + \tfrac{1}{2}O_2 + H_2O \end{array} \quad (II)$$

As may be seen equation (II) in comparison with equation (I), the electrochemical process of the invention produces the same amount of chlorine dioxide while half the amount of water is produced and half the amount of acid is consumed, as compared to the chemical process. The chlorine dioxide which is produced in the process of the invention is substantially pure since the reactions do not produce chlorine.

No chlorine dioxide is produced from the acidic aqueous chlorate solution in the absence of an applied cathodic current. The cathode which is used in the process of the invention may be constructed of any convenient electro-conductive material which is chemically inert (i.e. has no catalytic properties) to the chemical production of chlorine dioxide by reduction of chlorate ions in the acid aqueous reaction medium, in contrast to the materials described in U.S. Pat. No. 4,426,263 referred to above. Suitable cathode materials include the platinum group metals and, preferably in view of its cheapness and ease of use, carbon in any form, for example, graphite and vitreous carbon. The use of a carbon cathode also is advantageous, since it stabilizes the intermediate state, that is, the chlorite ions, against further electroreduction to a lower valency state, such as $ClO^-$ or $Cl^-$.

GENERAL DESCRIPTION OF INVENTION

Figure 1:
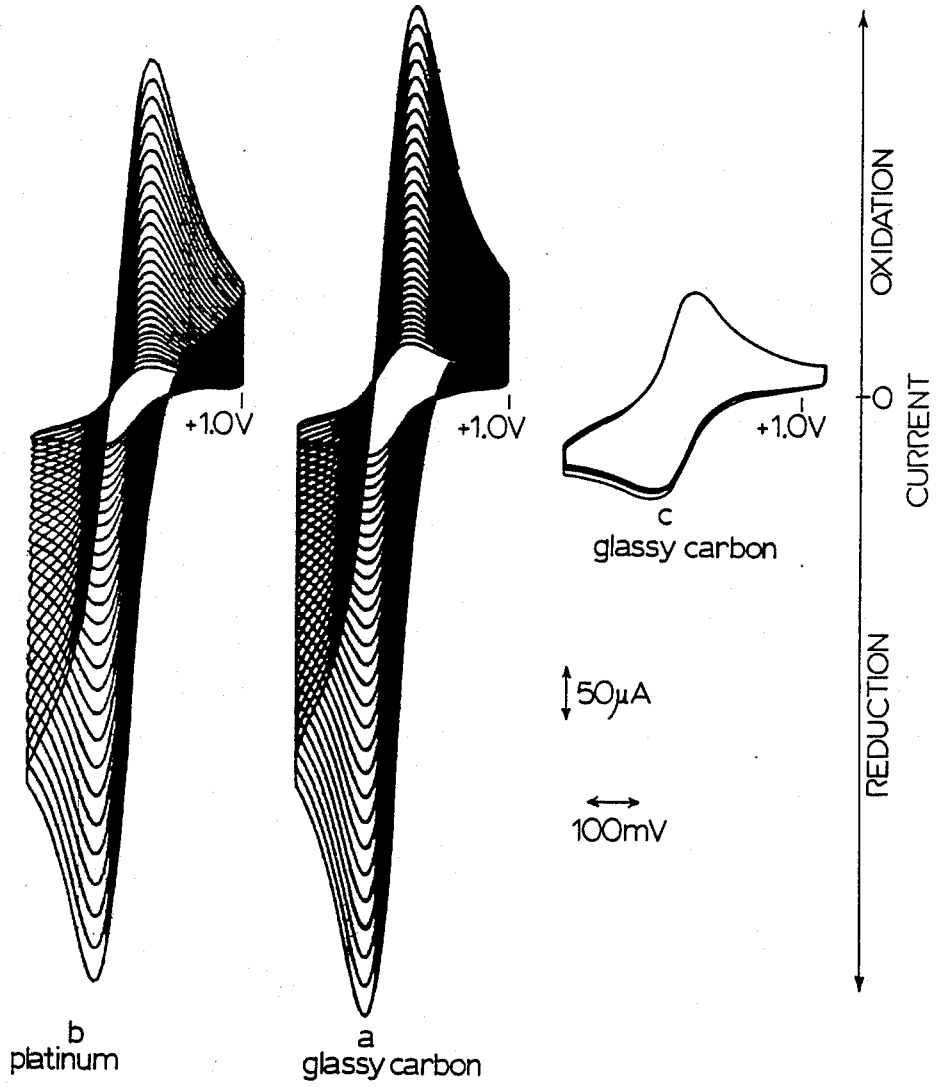
FIG. 1 contains a series of three voltammetric curves obtained in experiments described in the Examples below.

As noted above, the chlorine dioxide which is produced electrochemical in this invention is obtained free from chlorine, since chlorine is not produced by the reactions depicted by the equations given above. Chlorine generation is possible only if chloride ions are present in the reaction medium.

The possibility exists for the production of chloride ions by the acidic decomposition of chlorite ions if the excess of chlorate ion in the acid medium is insufficient, in accordance with the following equation:

$$5ClO_2^- + 4H^+ \rightarrow 4ClO_2 + Cl^- + 2H_2O$$

The chloride ion produced in this way then can react chemically with the chlorate ions in accordance with the reaction depicted in equation (I) above to produce chlorine as well as chlorine dioxide. Although chlorine dioxide still is formed, the coproduction of chlorine represents an inefficiency with respect to the production of chlorine dioxide from chlorate ions and also is a source of current inefficiency.

The electrochemical process of the invention may be carried out under a wide range of process conditions. Essential to the present invention is the provision of an aqueous acid electrolyte solution containing dissolved chlorate ions and having a total acidity greater than that of about 7 normal sulphuric acid. At acidities corresponding to below about 7 normal sulphuric acid, the production of pure chlorine dioxide is not possible.

The acidity may be provided most conveniently by sulphuric acid although any other strong mineral acid, other than hydrochloric acid, or a mixture of acids, may be employed, such as perchloric acid ($HClO_4$), orthophosphoric acid ($H_3PO_4$) or nitric acid ($HNO_3$). Hydrochloric acid is avoided, since the introduction of chloride ions would produce the undesired side chemical reaction with chlorate ions to produce chlorine dioxide and chlorine. An acid aqueous chlorate solution having a total acidity corresponding to that of about 9 to about 11 normal sulphuric acid is preferred.

The chlorate ions in the electrolyte are provided preferably by sodium chlorate, since this chemical is the most readily-available form of chlorate. However, other alkali metal chlorates, such as potassium chlorate, lithium chlorate, rubidium chlorate and cesium chlorate may be used, as well as alkaline earth metal chlorates, such as beryllium chlorate, magnesium chlorate, calcium chlorate, strontium chlorate, barium chlorate and radium chlorate, and mixtures of two or more of such chlorates. The concentration of chlorate ions in the electrolyte may vary widely from about 0.001 to about 7 molar, preferably about 0.1 to about 2 molar.

In order to sustain the reactions which are thought to be involved in the electrochemical process of the invention, it is essential to maintain a dissolved concentration of chlorine dioxide in the electrolyte. Chlorine dioxide generation ceases if all the produced chlorine dioxide is removed. In addition, some dissolved chlorine dioxide is necessary at start up. A concentration of dissolved chlorine dioxide in the range of about 0.01 to about 15 grams per liter (gpl) may be employed, preferably about 0.1 to about 8 gpl, at the initial startup and during the reaction.

In order to minimize side reactions and to maximize the overall chemical efficiency of the production of one mole of chlorine dioxide for each mole of chlorate ion consumed, the concentration of chlorate ion in the electrolyte should be in substantial excess to the concentration of dissolved chlorine dioxide, generally a molar excess of at least about 2:1, preferably at least about 10:1, usually up to about 1000:1.

Generally, the concentration of dissolved chlorine dioxide is maintained at a substantially uniform level by stripping chlorine dioxide at the rate of its formation. Chlorine dioxide spontaneously decomposes at high partial pressures thereof and it is necessary to dilute the chlorine dioxide well below the decomposition partial pressure, usually below about 100 mmHg. Any convenient diluent gas, usually air, may be used to strip the generated chlorine dioxide from the electrolytic cell and to provide the required dilution. Chlorine dioxide may be recovered from the off-gas stream by dissolution in water.

The electrical potential applied to the cathode during the electrochemical reaction depends on the material of construction of the electrode and usually varies from about +1.0 to about −0.5 Volts as compared with a saturated calomel electrode (SCE). For a carbon electrode, the preferred potential is approximately +0.4 Volts while for a platinum electrode, the preferred potential is approximately +0.7 Volts. The process usually is operated under constant voltage conditions while the current also preferably is constant.

The temperature of operation of the cell affects the purity of the chlorine dioxide gas which is obtained. Higher temperatures favour the formation of chloride ions by decomposition of chlorite ions, as described above, in accordance with the equation:

$$5ClO_2^- + 4H^+ \rightarrow 4ClO_2 + Cl^- + 2H_2O$$

As discussed above, formation of chloride ions in this way results in the formation of chlorine, with the consequent loss of efficiency and chlorine dioxide purity. Accordingly, it is preferred to operate at temperatures below about 40° C., more preferably at ambient temperatures of about 20° to about 25° C.

The process of the present invention may be carried out in any convenient cell arrangement in which anode and cathode electrodes are located and between which current may be passed. The cell may be divided physically into anolyte and catholyte chambers by any convenient cation-exchange membrane. With a divided cell arrangement, the aqueous acid chlorate solution is fed to the cathode compartment while water is fed to the anode compartment, the latter containing an electrolyte, such as an acid solution.

However, operation in an undivided cell or a cell with a simple non-membrane separator also is possible. As noted above, the electrochemical reaction at the cathode surface is believed to be the formation of chlorite ion from chlorine dioxide. In an undivided cell, such chlorite ions will attempt to migrate to the anode but are consumed by the chlorate ions present in large excess in the electrolyte to form chlorine dioxide, so that the chlorite ions never reach the anode and, in addition, their lifetime in the acidic medium is very short.

The generation of chlorine dioxide by the process of the invention is accompanied by the formation of by-products. As noted earlier, the anodic reaction in the cell produces gaseous oxygen, which may be vented in any convenient manner. The other by-products are water produced by the electrochemical reaction and a salt of the cation of the chlorate and the anion of the acid consumed in the process. These may be removed respectively by any convenient procedure, such as by evaporation and crystallization outside the cell.

The present invention, for the first time, provides an electrochemical process for generating chlorine dioxide from chlorate which does not rely on chemically-catalytic electrode materials. Chlorine dioxide is produced in pure form from an aqueous acid chlorate solution by passing a cathodic current through the solution from a cathode constructed of material chemically inert with respect to the formation of chlorine dioxide from the solution.

EXAMPLES

Example 1

Cyclic voltammetric studies were effected on an aqueous solution containing about 0.1 g/L of chlorine dioxide, 1M $NaClO_3$ and 10N $H_2SO_4$, using, in one case, a glassy carbon electrode and, in another case, a platinum disc electrode, each having a surface area of 0.196 $cm^2$. The current was plotted against the applied potential and the results are reproduced as curves a (glassy carbon) and b (platinum) in FIG. 1. The initial potential applied was +1.0 V vs. SCE and a sweep rate of 0.1 $Vs^{-1}$ was used. A further run was made using glassy carbon on a solution from which the sodium chlorate was absent. These results are reproduced as curve c in FIG. 1.

It will be seen from the data presented in curves a and b in FIG. 1 that both the $ClO_2$ reduction current to $ClO_2^-$, which is proportional to the $ClO_2$ concentration, and corresponding reoxidation current of $ClO_2^-$ back to $ClO_2$, recorded during consecutive potential scans between +1.0 V and +0.6 V vs. SCE, increases substantially with the duration of the multicyclic experiments. This result indicates a progressive accumulation or self-perpetuated multiplication of chlorine dioxide in the proximity of the electrode, both for the glassy carbon and platinum electrode. In comparison, curve c of FIG. 1 shows no accumulation of chlorine dioxide in the absence of the chlorate ions.

Example 2

Electrolytic studies were carried out in a divided H-cell using reticulated vitreous carbon foam as the cathode material and platinum foil as the anode material. A potentiostatic mode of operation was adopted at a cathodic potential of +0.2 volt vs. $Hg/Hg_2SO_4$ as the reference electrode.

The catholyte of volume approximately 100 ml contained about 10N $H_2SO_4$, about 1M $NaClO_3$ and a variable initial dissolved $ClO_2$ concentration. During electrolysis, gaseous products, $ClO_2$ and $Cl_2$ were stripped to a potassium iodide (KI) trap by bubbling nitrogen and by applying a low level of vacuum. Both the nitrogen flow and the vacuum were adjusted to maintain a substantially constant level of electrolyte in the compartments and, at the same time, to maintain a substantially constant concentration of dissolved chlorine dioxide in the catholyte, so that the stripping rate of chlorine dioxide was approximately equal to the production rate of chlorine dioxide.

The electrolyte was analyzed for $ClO_2$, $Cl_2$, $ClO_3^-$, $Cl^-$, $ClO_2^-$ and acidity both before and after electrolysis while the KI trap was analyzed and changed every 30 to 60 minutes.

The results obtained are set forth in the following Table I:

TABLE I

AUTOCATALYTIC ELECTROREDUCTION OF $ClO_3^-$ to $ClO_2$

| NO. | INITIAL AMOUNTS IN mmols $ClO_2$ | $Cl_2$ | $NaClO_3$ | NaCl | INITIAL NORMALITY of $H_2SO_4$ | TEMP. [°C.] | AVERAGE CURRENT [A] | CHARGE [C] | BALANCE ON Cl % | CURRENT EFFICIENCY % | CHEMICAL EFFICIENCY % | $ClO_2/Cl_2$ MOLAR RATIO |
|---|---|---|---|---|---|---|---|---|---|---|---|---|
| 1 | 1.56 | 0.08 | 99.8 | 0.6 | 9.76 | 25 | 0.40 | 3000 | 99 | 95 | 95 | 40 |
| 2 | 1.56 | 0.08 | 99.8 | 0.6 | 9.76 | 25 | 0.43 | 4018 | 99 | 93 | 93 | 35 |
| 3 | 2.91 | 0.19 | 97.9 | 0.6 | 9.86 | 25 | 0.58 | 3643 | 96 | 88 | 89 | 33 |
| 4 | 3.51 | 0.11 | 182.2 | 0.4 | 9.58 | 25 | 0.58 | 9919 | 94 | 80 | 87 | 29 |
| 5 | 1.53 | 0.08 | 99.9 | 0.3 | 9.62 | 55 | 0.61 | 6997 | 103 | 83 | 93 | 20 |
| 6 | 1.58 | 0.10 | 99.5 | 0.4 | 9.98 | 65 | 0.85 | 11000 | 100 | 64 | 85 | 12 |
| 7 | 1.33 | 0.19 | 101.9 | 0.6 | 9.94 | 65 | 1.05 | 10000 | 96 | 67 | 86 | 18 |

As may be seen from Table I, the chemical and current efficiencies which were obtained were very high, particularly at ambient temperature. The current required was dependent on both dissolved chlorine dioxide concentration and temperature, with the temperature effect being much more significant. As may be seen from run No. 4, a significant increase in sodium chlorate concentration did not significantly affect the process.

The mole ratio of $ClO_2/Cl_2$, and hence the purity of chlorine dioxide, although good in all the experiments, was much better at ambient temperature and is in a good correspondence with the temperature dependence of current efficiency.

Chlorite ions postulated as short-lived intermediates in the autocatalytic process were not detected either in the catholyte and anolyte, before and after electrolysis.

Maintaining a residual chlorine dioxide concentration was critical for the operation of the process. In an experiment where all the chlorine dioxide was stripped from the solution, no further electrogeneration of chlorine dioxide was observed and the current measured under potentiostatic conditions went to zero.

SUMMARY OF DISCLOSURE

In summary of this disclosure, the present invention provides a novel method of producing chlorine dioxide by an autocatalytic cathodic electrochemical reduction of chlorate ions. Modifications are possible within the scope of this invention.

What I claim is:

1. An electrochemical process for the production of chlorine dioxide, which comprises:

passing a cathodic electrical current through an aqueous acidity solution of chlorate ions having a total acid greater than that of about 7 normal sulphuric acid and containing dissolved chlorine dioxide having a concentration of dissolved chlorine dioxide in the range of about 0.01 to about 15 gpl, using a cathode constructed of an electrochemically-active material which is also chemically inert and non-catalytic with respect to the production of chlorine dioxide from said aqueous acid solution; and removing generated chlorine dioxide from the aqueous acid solution while maintaining said range of dissolved chlorine dioxide concentration in said aqueous acid solution.

2. The process of claim 1 wherein said molar excess concentration of chlorate ions with respect to dissolved chlorine dioxide is at least about 2:1.

3. The process of claim 2 wherein said molar excess concentration is up to about 1000:1.

4. The process of claim 1 wherein said concentration of dissolved chlorine dioxide is in the range of about 0.1 to about 8 gpl.

5. The process of claim 1 wherein said cathode is constructed of carbon.

6. The process of claim 1 wherein said acid solution has an acidity corresponding to about 9 to about 11 normal sulphuric acid.

7. The process of claim 6 wherein said acid solution contains sulphuric acid.

8. The process of claim 7 wherein said aqueous acid solution has a chlorate concentration of about 0.1 to about 2 molar and said chlorate concentration is at least about 10:1 molar excess of the dissolved concentration of chlorine dioxide.

9. The process of claim 8 wherein said generated chlorine dioxide is removed from the aqueous acid solution at a rate corresponding to its rate of formation, so as to maintain a substantially uniform concentration of dissolved chlorine dioxide from the aqueous acid solution.

10. The process of claim 9 wherein said concentration of dissolved chlorine dioxide is maintained in the range of about 0.1 to about 8 gpl.

11. The process of claim 1, wherein an electrode potential of about +1.0 to about −0.5 Volt as compared to a saturated calomel electrode is applied to the cathode.

12. The process of claim 11 wherein said cathode is constructed of carbon and the electrode potential is approximately +0.4 Volts.

13. The process of claim 1 carried out at a temperature less than about 40° C.

14. The process of claim 13 wherein said temperature is about 20° to about 25° C.

* * * * *

UNITED STATES PATENT AND TRADEMARK OFFICE

CERTIFICATE OF CORRECTION

PATENT NO. : 4,767,510

DATED : August 30, 1988

INVENTOR(S) : Marek Lipsztajn

It is certified that error appears in the above-identified patent and that said Letters Patent is hereby corrected as shown below:

On the title page and Column 1, Title of invention should read

-- ELECTROLYTIC PRODUCTION OF CHLORINE DIOXIDE __.

Column 7, Claim 1, line 5, "acid" should read -- acidity --.

Signed and Sealed this

Thirty-first Day of January, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,767,510

DATED : August 30, 1988

INVENTOR(S) : Marek Lipsztajn

It is certified that error appears in the above-identified patent and that said Letters Patent is hereby corrected as shown below:

Column 7, claim 1, line 4, "acidity" should read -- acid --.

Signed and Sealed this

Sixth Day of March, 1990

*Attest:*

JEFFREY M. SAMUELS

*Attesting Officer*

*Acting Commissioner of Patents and Trademarks*